United States Patent [19]

Narens et al.

[11] 4,314,418

[45] Feb. 9, 1982

[54] MESSAGE CONTROL UNIT

[76] Inventors: Robert L. Narens, 8704A Gregory La., Des Plaines, Ill. 60016; Frank D. Billeck, 456 Chicory La., Buffalo Grove, Ill. 60090

[21] Appl. No.: 119,556

[22] Filed: Feb. 7, 1980

[51] Int. Cl.[3] ..... G09F 3/00

[52] U.S. Cl. ..... 40/358; 40/122; 40/312; 211/11

[58] Field of Search ..... 40/120, 122, 19.5, 124, 40/358, 16, 312, 313; 312/234.1, 234.2; 206/459; 220/21; 211/50, 10, 11

[56] References Cited

U.S. PATENT DOCUMENTS

| | | | |
|---|---|---|---|
| 740,321 | 9/1903 | Shaul | 40/124 X |
| 1,018,641 | 2/1912 | Strayer | 40/120 |
| 2,211,869 | 8/1940 | Tobita | 206/459 |
| 2,722,754 | 11/1955 | Slote | 40/11 R X |
| 3,484,967 | 12/1969 | Webb | 40/19.5 |

FOREIGN PATENT DOCUMENTS

| | | | |
|---|---|---|---|
| 12912 | of 1885 | United Kingdom | 40/122 |

*Primary Examiner*—Gene Mancene
*Assistant Examiner*—Wenceslao J. Contreras
*Attorney, Agent, or Firm*—Sixbey, Friedman & Leedom

[57] ABSTRACT

A compact, integrally molded message control center having a configuration easily and expensively formed by conventional molding processes including a plurality of upwardly opening parallel receptacles suitable for messages and an open bottom suitable for storage is provided. The front wall of the unit is inclined at an angle toward the back of the unit and supports a digital time and date unit and a cross lined chart on which personnel availability and location may be maintained by the movement of magnetic markers. Coordinated indentifying indicia are positioned along two sides of the unit, and these indicia are further coordinated with other indentifying indicia positioned on the front of the unit in combination with the chart.

11 Claims, 3 Drawing Figures

MESSAGE CONTROL UNIT

TECHNICAL FIELD

The present invention relates generally to information and message systems for use in offices and, in particular, to an integrally molded compact message control unit whereby information concerning messages and personnel location is provided in a coordinated, easily assimilated manner.

BACKGROUND ART

Office receptionists and switchboard operators have long had to deal with the difficulties presented by keeping track of other office personnel and their messages. Often there is no system by which messages are maintained for office personnel in a central location or by which the office staff is kept apprised of the whereabouts of their superiors or coworkers. Messages are likely to be left on the recipients's desk or the receptionist verbally informed regarding personnel location.

If a device is used for maintaining messages in a central location until picked up by the recipient, it is likely to be a system of frontwardly opening rectangular compartments or pigeonholes, typically mounted on a wall. While such devices do permit an improved measure of efficiency for the message taker, they are not without their disadvantages. The units are generally bulky and cumbersome and not sufficiently aesthetically pleasing to complement the decor of most office reception areas. More importantly, since the message receptacles are open at the front, the contents of the pigeonholes tend to fall out easily and become lost. Another drawback involves the absence of any provision for the integration of relevant personnel location information so that all important information concerning messages and personnel whereabouts is provided at a glance.

The prior art also includes devices used solely for the communication of information concerning the presence or absence of office personnel. This is typically accomplished by providing a wall mounted board including spaces for the names of office personnel and means for indicating the presence or absence of personnel, such as sliding indicator signals or magnetic markers like those disclosed in U.S. Pat. No. 2,951,703. These information boards increase dramatically in size as the number of people to be accounted for increases. In addition, the information communicated is limited to whether personnel are in the office or out and, if out, the expected time of return. The size and appearance of the aforementioned information boards make them awkward and cumbersome for office reception personnel to use efficiently. Moreover, these prior art personnel information boards provide no integral coordinated structure whereby message and personnel location information is quickly provided at a glance.

One known prior art unit has combined a set of pigeonholes with a personnel location board fastened along the upper surface to produce a unit smaller than those referred to above. While this unit represents an improvement over what was previously available, nevertheless it suffers from a number of disadvantages. Although intended to be used as a desk top unit, it is larger and more cumbersome than desirable for such a unit. In addition, the sliding time indicators and the arrangement of names and indicators on the board are difficult to read accurately at a glance, and there is no provision for any coordination between the pigeonholes and the information board. Because the pigeonholes are open both at the front and in the back, papers are even more likely to be lost than with a wall mounted pigeonhole unit. Although a piece of slotted metal is provided at the top of the unit for urgent messages, there is no way in which the intended recipient of such messages may be readily identified at a glance by office personnel passing by the unit. If the receptionist was unavailable or could not remember who had received such messages, these personnel would be required to go through all the messages to ascertain if one was intended for them, thus assuring that such messages could never be confidential. The primary drawback of this unit, however, lies in its failure to coordinate and integrate the functions of its structural components so that important information concerning office personnel is readily available and easily assimilated upon rapid visual inspection.

DISCLOSURE OF THE INVENTION

It is an object of the present invention, therefore, to provide an integrally molded compact message control unit including numbered upwardly opening receptacles for retaining messages, a digital time and date unit and an integrally formed inclined front wall supporting a magnetic personnel information chart and magnetic markers for conveying information so that important information concerning the existence of messages and the location of office personnel is quickly assimilated upon visual inspection of the unit.

It is another object of the present invention to provide an easily and inexpensively formed, integrally molded message control unit suitable for use on the top of a standard sized office reception desk having along the top portion a plurality of upwardly opening parallel receptacles or pockets for messages and the like, having mounted to the front wall a coordinated easily read chart designed to convey at a glance specific information regarding the personnel to whom message receptacles have been assigned, and having an open bottom to provide concealed storage space.

It is yet another object of the present invention to provide a compact integrally molded message control center including a hollowed out portion accessible from the underside of the unit for concealing letters, small packages and the like from public view.

It is an additional object of the present invention to provide a compact message control unit generally shaped like a truncated right triangle when viewed from either end, with the intersection of the back wall of the unit and the desk or other surface upon which the unit is placed forming a right angle and the intersection of the front wall of the unit and the desk or other surface upon which the unit is placed forming an angle of less than 90°, so that the front wall of the unit is inclined toward the back of the unit.

It is a further object of the present invention to provide a compact message control unit having on the top and on the front coordinated easily read identifying indicia which are further coordinated with complementary identifying indicia and information on the front of the unit regarding the availability and location of office personnel so that all important information may be quickly assimilated upon rapid visual inspection.

Further objects and advantages will become apparent from the following description and claims and from the accompanying drawings.

In accordance with the present invention a compact, integrally molded message control center is provided having a configuration which is easily and inexpensively formed by conventional molding processes. The unit includes along the top a plurality of upwardly opening parallel receptacles suitable for messages and further includes an open bottom which provides concealed storage space. Coordinated identifying indicia are positioned along two sides of the unit, and these indicia are further coordinated with other identifying indicia positioned on the front of the unit in combination with a digital time and date unit and a cross lined chart on which personnel availability and location may be maintained by the movement of magnetic markers.

BEST MODE FOR CARRYING OUT THE INVENTION

The message control unit of the present invention provides office reception personnel with a compact, centralized communication center which is more easily and efficiently utilized to perform its intended function than heretofore available message and personnel information units.

Figure 1:
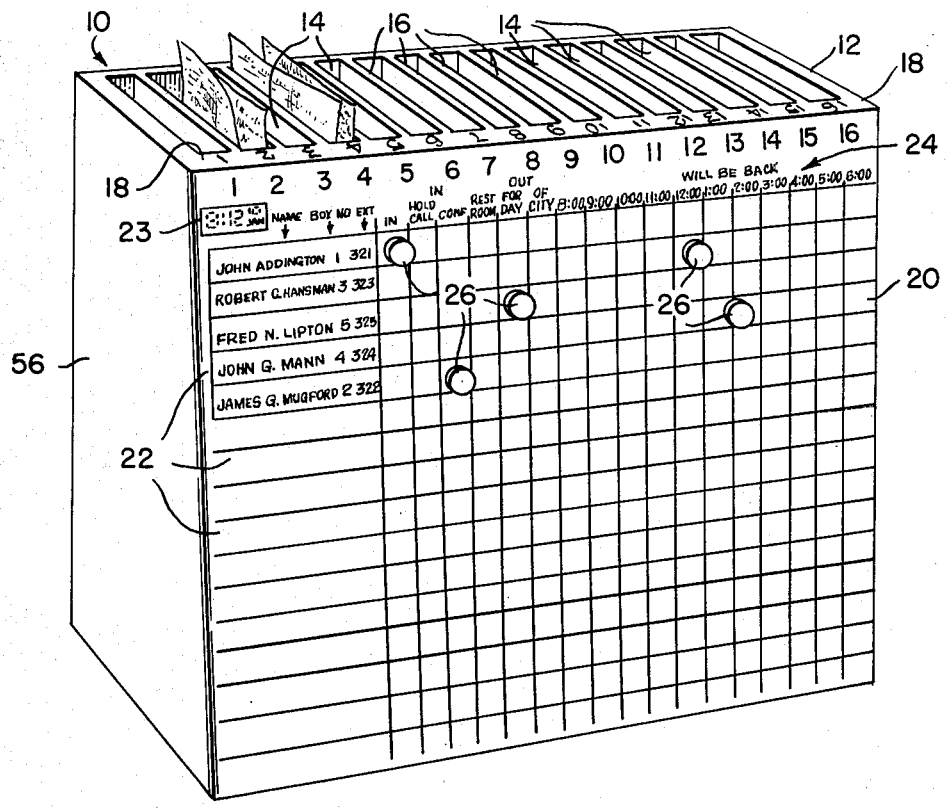
FIG. 1 is a front perspective view of the message control unit of the present invention.

Referring to the drawings, FIG. 1 illustrates a front perspective view of the message control unit 10 of the present invention. This is the perspective from which an office receptionist or switchboard operator would view the unit. Across the top 12 of the unit is a plurality of parallel receptacles 14 integrally molded within the unit and separated by partitions 16. Each receptacle 14 is assigned a number, i.e. one to sixteen, as shown in FIG. 1. It has been found to be convenient to divide the preferred embodiment of the unit into sixteen receptacles, but this number could be varied by decreasing the spacing between the receptacle partitions 16 or by increasing the size of the unit. A widened upper front ledge 18 of unit top 12 has been provided so that there is sufficient room for the placement of numbers or other identifying indicia for each receptacle so that the numbers can be easily read when the unit is viewed from the back. A corresponding set of numbers or other identifying indicia is also placed along the upper edge of the front of the unit so that the numbers or other identifying indicia can be easily viewed from the front by the person maintaining the unit.

The front wall of the unit supports, in a manner to be described in detail hereinbelow in conjunction with FIG. 2, a plate which will support magnetic markers. On this plate is embossed or printed by conventional means a chart 20 which may include the type of information shown in FIG. 1. While the information on chart 20 may vary from that shown in FIG. 1 and still fall within the scope of the present invention, the information illustrated in FIG. 1 has been found to be the most convenient and helpful to the efficient use of the unit. The orthogonal arrangement of the chart illustrated in FIG. 1 includes a vertical axis containing a sufficient number of vertical subdivisions 22 to correspond to the numbered receptacles. Each of these subdivisions may include self-adhesive labels containing the names of office personnel, a number or other identifying indicia to correspond to the number or other identifying indicia for one of the receptacles and any other pertinent or helpful information, such as a telephone extension number.

An additional feature of the compact message control unit of the present invention is a digital time and date unit 23. This is conveniently located in the upper left section of the front of the unit, although the placement could be varied to suit individual preference. The provision of the digital time and date unit 23 enhances the convenience of the unit and assures that the correct time and date are readily available, which increases the likelihood that the time and date will be accurately recorded on the message sheet.

The cross lined portion of the chart 20 includes along the top horizontal axis specific information such as whether personnel are in or out and, if in, whether they are available for calls and, if out, whether they are out of town or out of the office. A time chart 24 is provided to indicate the expected time of return. Removable magnetic markers 26, which can be round as shown in FIG. 1 or any other convenient shape, are placed in the appropriate space to indicate the necessary information. These elements cooperate to provide all the necessary information at a glance. For example, it is quickly apparent to the receptionist that John G. Mann, to whom is assigned to receptacle or box numbered 4, will be back in the office between 1:00 and 2:00 P.M. and has messages in his box. When John G. Mann returns to the office, he can quickly ascertain while passing the reception desk that there are messages in his box and pick them up. In addition, if James G. Mugford, to whom is assigned the receptacle or box numbered 2, receives any calls, the receptionist can glance at the chart, quickly determine that he is in conference, take an appropriate message, including the exact date and time of the call, and place it in the receptacle number 2. If an office includes more than sixteen persons, additional message control units can be placed side by side and numbered sequentially up to 32, 48 or whatever is required.

Figure 2:
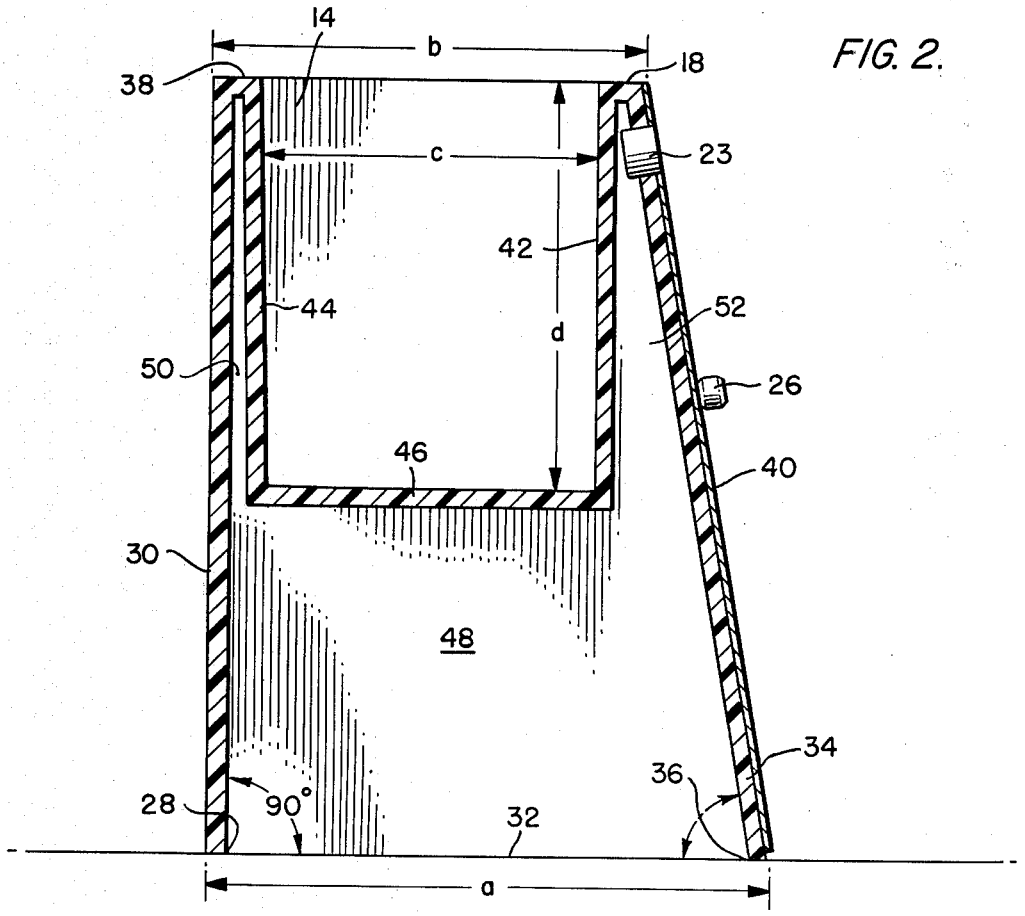
FIG. 2 is an end cross-sectional view of the message control unit of FIG. 1.

FIG. 2 illustrates in end cross-sectional view the details of the unique structure of the message control unit of the present invention. By providing receptacles 14 along the top of the unit and by leaving the bottom open, the unit is easily and inexpensively constructed by conventional molding processes, preferably of a suitable plastic material. In end view, the message control unit of the present invention resembles a truncated right triangle in shape. The right or 90° angle is formed at 28 by the intersection of the back wall 30 and the surface 32 upon which the unit is placed, typically the top of a desk. The intersection of the front wall 34 of the unit with surface 32 forms an angle of less than 90°. The result of this is to incline front wall 34 toward back wall 30 so that the front to back distance a at the bottom of the unit is greater than the front to back distance b at the top of the unit. This inclination of front wall 34 functions to make chart 20 easier to read than if wall 34 supported chart 20 perpendicularly to surface 32. The degree of inclination of wall 34 is limited by at least two factors, one of which concerns the relationship between the inclination of the chart and ease with which it is read and the second of which concerns the front to back distance c of receptacles 14. There appears to be a point beyond which increasing the degree to which front wall 34 inclines away from the vertical and toward back wall 30 does not increase, but rather, decreases the readability of chart 20 supported on wall 34. Hence, some effort should be made to keep the inclination of wall 34 within a zone maximum readability of chart 20. In the preferred embodiment of the message control center of the present invention, distance c is selected so that receptacles 14 can accommodate most commonly used sizes of message paper. In addition, in determining the magnitude of angle 36, the requirement for providing ledge 18 whereon identifying indicia for receptacles 14 can be placed must be considered. Although the preferred embodiment contemplates placement of these indicia at 18, ledge 38 could alternatively be widened to support identifying indicia. The choice of whether to provide a widened ledge at 18 or 38 should affect the degree of inclination of front wall 34 only slightly.

Front wall 34 supports a plate 40 on which is embossed or printed chart 20. The preferred material for the construction of plate 40 is a ferrous metal. Utilization of this type of material permits the use of removable magnetic markers 26 to convey information in the manner described in conjunction with the discussion of FIG. 1 hereinabove. However, any paramagnetic material capable of supporting removable magnetic markers may be used to form plate 40. Plate 40 may be secured to the surface of front wall 34 by any method of bonding ferrous metal or any like paramagnetic material to the plastic or like material of which message control unit 10 is constructed.

It will be further observed from FIG. 2 that receptacle 14 is generally rectangular in shape when viewed from the end of the unit. The distance c between receptacle front wall 42 and receptacle back wall 44 and the distance d between receptacle bottom wall 46 and the top of the unit shown in the preferred embodiment have been selected to accommodate the sizes of most commercially available message papers. However, the overall shape of receptacle 14 as well as distances c and d may be varied from those shown and still be within the scope of the present invention. Optimally, distance d will be selected to facilitate production of the unit by conventional molding techniques so that the molding process may be carried out quickly and inexpensively.

The message control unit of the present invention includes, in addition, space 48 between bottom wall 46 of receptacle 14 and the bottom of the unit. The depth of space 48 may vary according to the dimension selected for distance d. If, as shown in FIG. 2, the depth of receptacle 14 occupies approximately half of the overall height of the unit, space 48 will be large enough to provide concealed storage space for letters, small packages, message pads, and the like. Access to space 48 is gained simply by lifting the unit up and away from surface 32.

Additional features of the structure of the present message control unit which are apparent from FIG. 2 function to facilitate the molding process by which the unit is formed. A space 50 between unit back wall 30 and receptacle back wall 44 and a space 52 between unit front wall 34 and receptacle front wall 42 allows the receptacle walls to be formed integrally with the walls of the unit.

Figure 3:
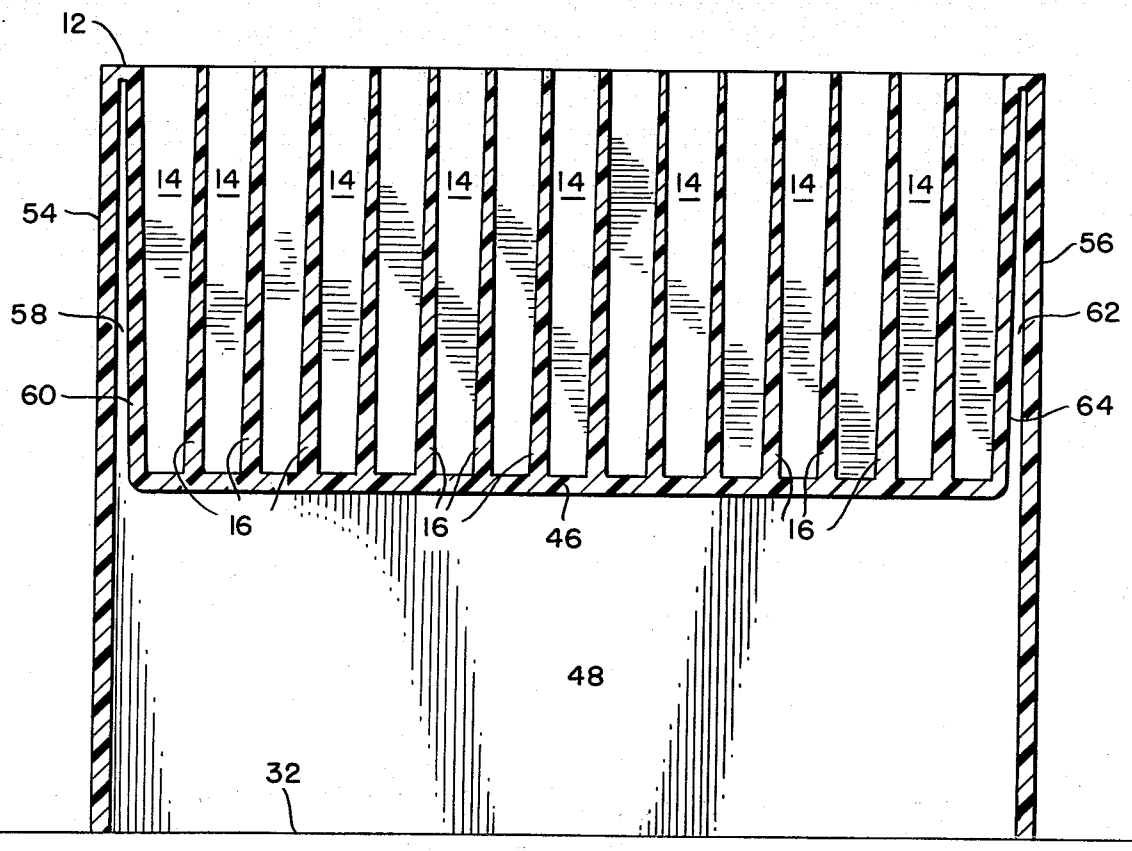
FIG. 3 is a back cross-sectional view of the message control unit of FIG. 1.

FIG. 3 illustrates a back cross-sectional view of the unit showing sixteen separate message receptacles 14 divided by partitions 16. The end walls of the unit are shown at 54 and 56. The provision of triangular shaped space 58 between unit end wall 54 and end wall 60 of the last message receptacle at that end of the unit and the provision of triangular shaped space 62 between unit end wall 56 and end wall 64 of the last message receptacle at the end of the unit greatly facilitates the molding process by which the unit is formed and permits the formation of message receptacles 14 and partitions 16 integrally with the remainder of the unit. FIG. 3 also illustrates another view of space 48 from that shown in FIG. 2. As can be seen from this view, if the relative dimensions shown in the preferred embodiment of the unit are used, space 48 can provide a convenient concealed storage area.

The dimensions of the message control unit of the present invention are not limited and may be any dimensions required to produce a finished unit of the size desired. The dimensions of the preferred embodiment have been selected to provide a compact unit suitable for use on an office receptionist's or switchboard operator's desk top. It has been found convenient to provide a unit in which the distance between end walls 54 and 56 is about 11 to 12 inches, the top to bottom distance is about 9 to 10 inches, and the distance between front wall 34 and back wall 30 is about 6 to 7 inches at the bottom and about 5 to 6 inches at the top. In addition a message receptacle having a distance c of about 4 inches and a distance d of about $4\frac{1}{2}$ to 5 inches has been found to accommodate conveniently most available message papers. These dimensions permit enough of the message paper to protrude above the top of the unit to indicate upon rapid visual inspection that the receptacle has a message in it, and, at the same time, provide privacy by concealing most of the paper, including that portion upon which the message is written.

Other aspects, objects and advantages of this invention can be obtained from a study of the drawings, the disclosure and the appended claims.

INDUSTRIAL APPLICABILITY

The message control unit of the present invention will find its primary use in assisting office reception and switchboard personnel having the responsibility for receiving and maintaining incoming calls and messages for other office personnel. Since the present message control unit provides all necessary and important information concerning the availability of personnel in a form that is readily assimilated at a glance, it is anticipated that the utilization of the unit, even in an office with a relatively small number of employees, will provide a savings in time and an increase in the efficiency with which reception or switchboard tasks are performed.

We claim:

1. A message control unit for use in an office reception area or like environment whereby information concerning messages and personnel availability is provided in a coordinated form which is quickly and easily assimilated upon rapid visual inspection, said message control unit comprising:

(a) receptacle means for receiving and storing messages, the top edges of said receptacle means all being situated in one plane and the bottom walls of said receptacle means all being situated in a second plane parallel to said first plane;

(b) first wall means formed integrally with said receptacle means for supporting an attached plate, said attached plate including chart means for organizing and presenting selected information in an orthogonal pattern, said first wall means further including a digital time and date unit;

(c) a pair of second wall means integrally formed with said receptacle means for connecting the sides of said first wall means with said receptacle means; and (d) third wall means for connecting said pair of second wall means together and with said receptacle means.

2. The message control unit described in claim 1, wherein said receptacle means comprises a plurality of substantially parallel, substantially rectangularly shaped upwardly opening receptacles having the long side of said rectangular opening perpendicular to said first and third wall means and the short side of said rectangular opening parallel to said first and third wall means.

3. The message control unit described in claim 2, wherein the integral connection of said first wall means and said third wall means by said pair of second wall means results in said pair of second wall means being shaped like a pair of truncated right triangles.

4. The message control unit described in claim 3, wherein said plate is formed of a paramagnetic material.

5. The message control unit described in claim 4, wherein said plate is formed of a ferrous metal.

6. The message control unit described in claim 5, wherein the top edges of said first, second and third wall means are widened to form a ledge, the ledge formed by the widened top edge of said first wall means being wider than the ledge formed by the top edges of said second and third wall means.

7. The message control unit described in claim 6, wherein a plurality of sequentially arranged identifying indicia is placed along the length of the widest section of said ledge so that each one of the plurality of identifying indicia is positioned on said ledge directly in front of each one of said receptacles.

8. The message control unit described in claim 7, wherein the upper section of said front wall means directly adjacent the widest portion of said ledge includes a duplicate set of said plurality of sequentially arranged identifying indicia positioned along said upper section, the duplicate set of indicia being located directly adjacent the corresponding identifying indicia positioned along said ledge.

9. The message control unit described in claim 8, wherein removable magnetic markers are positioned on said chart means to communicate information contained thereon.

10. The message control unit described in claim 9, wherein the bottom wall of said receptacles is positioned above the lowest point of said first, second and third wall means to form storage means for concealing from public view articles placed therein.

11. A message control unit for use in an office reception area or like environment whereby information concerning messages and personnel availability is provided in a coordinated form which is quickly and easily assimilated upon rapid visual inspection, said message control unit comprising:

(a) a front wall supporting an attached plate including a chart for organizing and presenting selected information in an orthogonal pattern, a digital time and date unit, and a first set of sequentially arranged identifying indicia corresponding to each horizontal line on said chart, said plate being formed of a paramagnetic material and removable magnetic markers being used on said chart to communicate information contained thereon;

(b) a pair of side walls integrally formed with said front wall, said side walls being shaped like a truncated right triangle with the hypotenuse of said triangle being positioned at the intersection of said front wall and said side walls so that said front wall is inclined away from the perpendicular;

(c) a back wall integrally formed with said connecting pair of side walls;

(d) a plurality of substantially parallel, rectangular, upwardly opening receptacles positioned with the long side of the rectangle perpendicular to and between said front and back walls and the short side of the rectangle parallel to said front and back walls, said receptacles having top edges situated in the same plane and a bottom wall positioned above the lowest point of said front, side and back walls to form a concealed storage area under the receptacles; and (e) a ledge formed by the widened top edges of said front side and back walls integrally connecting said receptacles with said front, side and back walls and including in the area between the top of the front wall and the front edge of the receptacles a second set of identifying indicia identical to said first set of identifying indicia, which corresponds to each receptacle and to a third set of identical identifying indicia positioned along the top of the front wall.

* * * * *